United States Patent [19]

Josef

[11] Patent Number: 4,633,596

[45] Date of Patent: Jan. 6, 1987

[54] PAPER MACHINE CLOTHING

[75] Inventor: Michael J. Josef, Clifton Park, N.Y.

[73] Assignee: Albany International Corp., Menands, N.Y.

[21] Appl. No.: 298,320

[22] Filed: Sep. 1, 1981

[51] Int. Cl.[4] ..... F26B 13/00

[52] U.S. Cl. ..... 34/116; 34/123; 139/383 A; 139/420 A

[58] Field of Search ..... 139/383 A, 420 A; 428/244; 162/289, 358; 34/111, 116, 123

[56] References Cited

U.S. PATENT DOCUMENTS 4,161,195 7/1979 Khan ..... 139/383 A

FOREIGN PATENT DOCUMENTS 695380 10/1964 Canada .

*Primary Examiner*—Larry I. Schwartz

*Attorney, Agent, or Firm*—Kane, Dalsimer, Kane, Sullivan & Kurucz

[57] ABSTRACT

Paper machine clothing comprising interwoven machine direction and cross-machine direction yarns are provided, wherein the machine direction yarns are monofilaments having a cross-sectional configuration such that the center is thinner than the lateral edges. The woven fabrics, after heat-setting, exhibit exceptional dimensional stability in the diagonal direction.

3 Claims, 6 Drawing Figures

FIG. 4
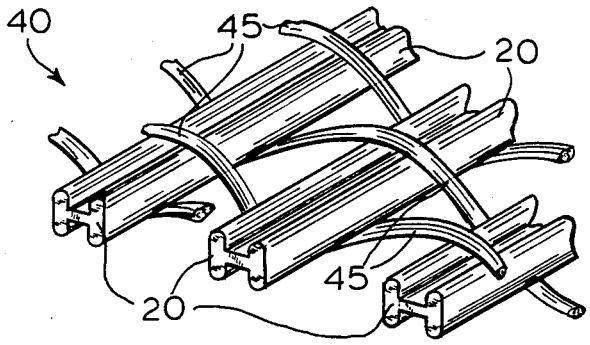
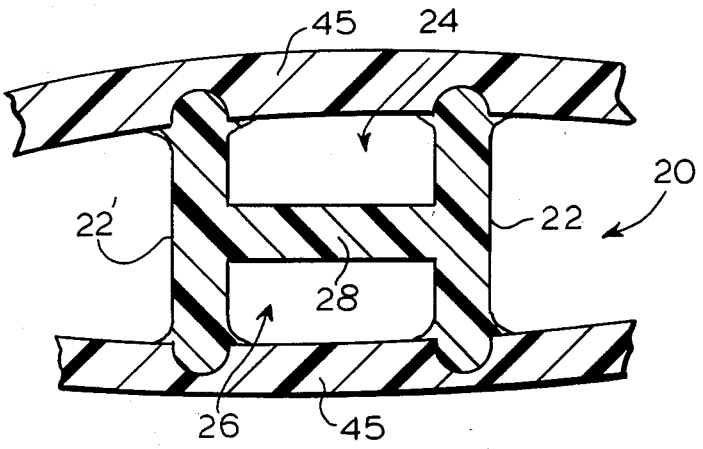
FIG. 5
FIG. 6
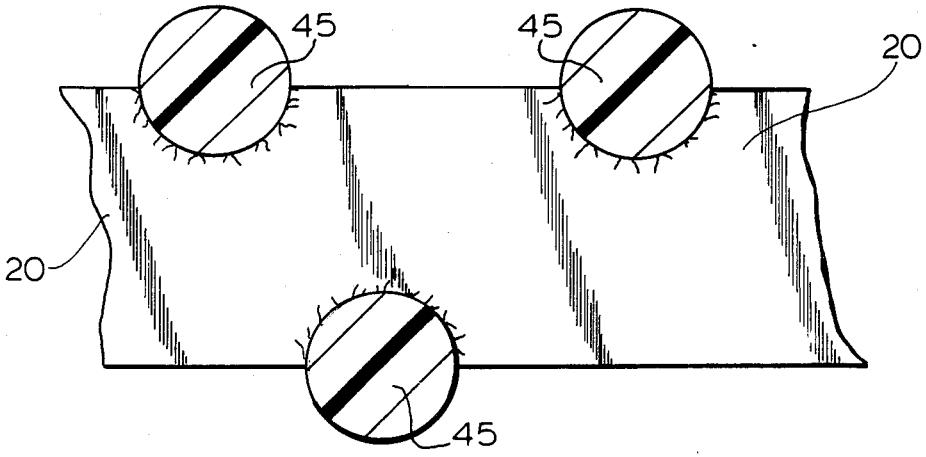

PAPER MACHINE CLOTHING

BACKGROUND OF THE INVENTION

1. Field of the Invention

The invention relates to paper machine clothing useful for fabrication of dryer belts, employed in the dryer section of a papermaking machine, wet belts employed in the press section of such machines and forming wires which may be used on fourdrinier and cylinder machines and more particularly relates to such fabrics made from monofilaments of synthetic polymer resins.

2. Brief Description of the Prior Art

Papermaking machines are well known in the art. The modern papermaking machine is in essence a device for removing water from the paper furnish. The water is removed sequentially in three stages or sections of the machine. In the first or forming section, the furnish is deposited on a moving forming wire and water drained through the wire to leave a paper sheet or web having a solids content of circa 18 to 25 percent by weight. The formed web is carried into a wet press felt section and passed through one or more nip presses on a moving press felt to remove sufficient water to form a sheet having a solids content of 36 to 44 percent by weight. This sheet is transferred to the dryer section of the papermaking machine where dryer felts press the paper sheet to hot steam heated cylinders to obtain a 92 to 96 percent solids content.

On papermaking machines, endless belts are employed in the various sections to carry the sheet or web of paper. There are a wide variety of forms of the endless belts, some fabricated from metal and others from textile material such as cotton, cotton and asbestos or cotton, asbestos and synthetic fibrous or filamentous materials. The selection of a given material is dependent to some degree upon the use to which the fabric will be put, i.e.; as a forming fabric, dryer felt, etc.

One form of belt which has been used extensively as a forming wire in the forming section of the papermaking machine is one fabricated from an open weave of synthetic, polymeric resin monofilaments. Such fabrics generally perform well in the forming section although there are certain limitations. For example, the relatively open weaves, particularly when run at highest speeds, lack dimensional stability. This shortens the overal life of the forming wire which is subject to abrasion as it shifts in position on the machine.

Dryer belts for use in the drying section of the papermaking machine have historically been fabricated from dryer felt fabrics. In recent years, one form of belt commonly employed in the dryer section of a papermaking machine is referred to as a "screen" and is fabricated by weaving synthetic monofilaments or twisted multi-filaments together in an open weave. Although not subjected to any form of milling, and therefore not "felts" in the original sense of the term, these screen fabrics have also become known as "dryer felts". The endless belts are generally woven flat and the ends thereafter joined to form an endless belt. The weave selected may be a two or three layer weave of synthetic yarns such as multifilament, spun or monofilament yarns.

In carrying the formed paper web through the dryer section of the papermaking machine, the felt aids in drying, controls shrinkage of the paper web and prevents cockles. The felt fabric must possess strength, dimensional stability, resistance to chemical and thermal degradation, resistance to abrasion and have a functional permeability. In recent years all monofilament structured fabrics have been developed to meet the above-described needs of a dryer felt. However, dryer felts fabricated from all monofilament fabrics, have heretofore not been entirely satisfactory. Generally, the previously used fabrics have had relatively rough surfaces, which are brought in contact with the paper sheet to be dried. This rough surface can mark the paper sheet. This of course may be highly undesirable, resulting in a high percentage of unsatisfactory paper product.

It will also be appreciated that the screen type of "dryer felt" fabric is relatively open in design, resulting in a relatively high fabric permeability, i.e.; ;air permeability on the order of from about 70 to 700 CFM/sq. ft. at ½" water. Such fabrics advantageously permit free vapor passage through the fabric during operation of the papermaking machine. The high permeability of the fabric can be controlled by the incorporation of stuffer picks, as is well-known in the art; see for example British Pat. No. 1,207,446. However, the open design also means that the fabric may have lower dimensional stability, even if stuffer picks are included. This can be a problem, affecting the quality of paper being manufactured on the machine and the life of the dryer felt.

In any position on the papermaking machine, belts fabricated from monofilaments of synthetic polymeric resins are subject to abrasion and moist heat hydrolysis. In many of the prior art constructions the load bearing machine direction monofilament yarns may be rapidly degraded under some conditions of use so that the life of the dryer felt is shortened.

With the structured fabrics of the present invention, many of the above-described shortcomings of the prior art are removed. Dryer belts constructed according to the invention may be fabricated from an all monofilament fabric which provides an exceptionally smooth surface to contact the paper sheet. As a result, relatively mark free paper product is obtained, while all of the desired advantages of an all monofilament dryer felt are retained. The monofilament machine direction yarns employed in the fabrics of the invention are more resistant to degradative elements. The overall operating life of the forming wires and felts is significantly increased over prior art felts.

It will be appreciated that there is an extensive range of prior art descriptions in the field of papermaker's fabrics. Representative of such descriptions are those found in U.S. Pat. Nos. 2,260,940; 2,354,435; 2,748,445; 3,060,547; 3,158,984; and British Pat. No. 980,288.

SUMMARY OF THE INVENTION

The invention comprises a papermachine clothing fabric, which comprises;

a plurality of interwoven machine direction and cross-machine direction yarns, said cross-machine direction yarns being selected from the group consisting of mono- and multifilament yarns, said machine direction yarns being generally rectangular monofilaments of a synthetic, polymeric resin having a cross-sectional configuration such that the monofilaments are thinner at their center than at their lateral edges;

crossover points between the interwoven machine direction and cross-machine direction yarns being sited on the thicker lateral edges of the machine direction yarns;

the cross-machine direction yarns being interlocked with the machine direction yarns at the crossover points;

said fabric having the characteristics associated with a heat-set fabric.

The term "rectangular" as used herein is inclusive of a square shape.

BRIEF DESCRIPTION OF THE DRAWINGS

FIG. 4 is an enlarged view of a portion of a fabric of the invention (the machine-direction yarns are greatly enlarged over the cross-machine direction yarns to show details).

FIG. 5 is an enlarged cross-sectional side elevation of a machine-direction yarn in the fabric of FIG. 4, showing the relationship of the cross-machine direction yarns thereto.

FIG. 6 is an enlarged cross-sectional side elevation of the cross-machine direction yarns in the fabric of FIG. 4.

DETAILED DESCRIPTION OF THE PREFERRED EMBODIMENTS OF THE INVENTION

Those skilled in the art will gain an appreciation of the preferred embodiments of the invention by a reading of the following description in conjunction with a viewing of the accompanying drawings of FIGS. 1-6, inclusive.

Figure 1:
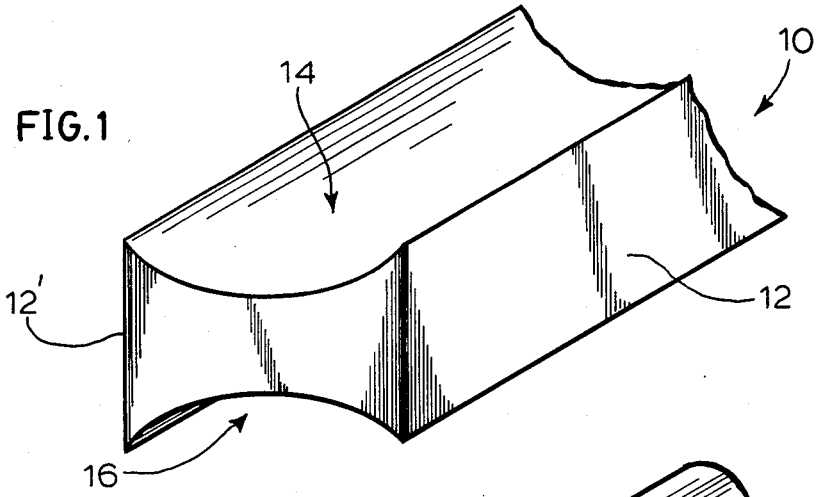
FIGS. 1-3 are views-in-perspective of portions of monofilament types used in the manufacture of fabrics of the invention.
Figure 2:
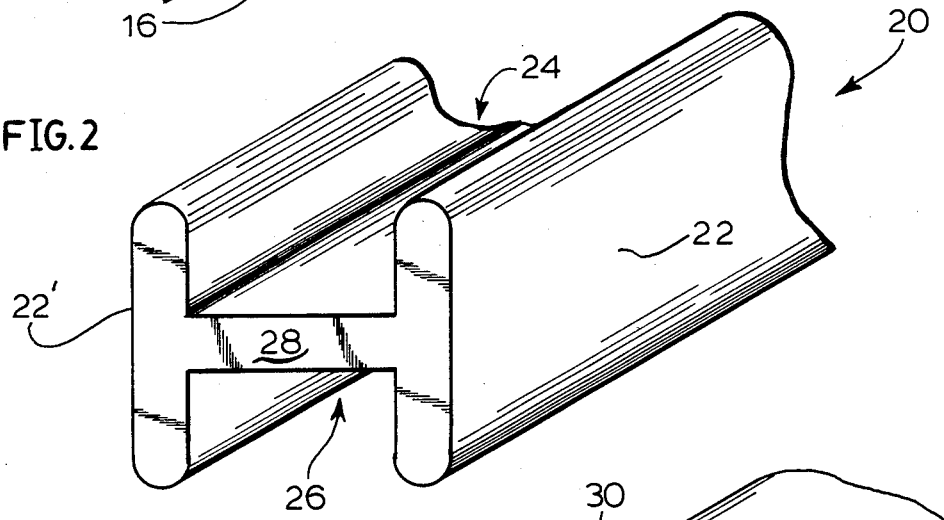
Figure 3:
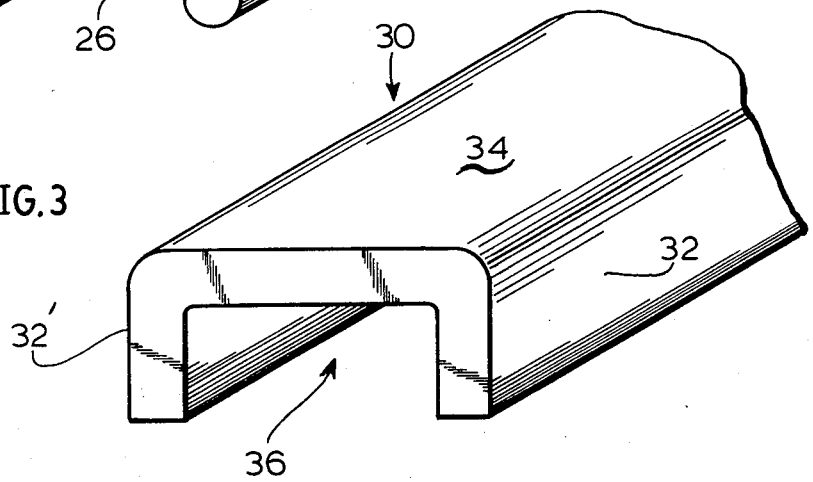

FIGS. 1-3, inclusive, show views-in-perspective of portions of monofilament type used in the manufacture of fabrics of the invention. In the FIG. 1, monofilament 10 has a generally rectangular or squared cross-section, with a concave upper surface 14 and a concave lower surface 16 joining side or lateral edges 12,12'. The center of the monofilament 10 is distinguished by a thinner dimension at its center than at the lateral edges 12,12'.

The monofilament 20 of FIG. 2 is generally similar to the monofilament 10, having a depressed upper surface 24 and a depressed lower surface 26 between lateral edges 22,22' which are joined by the thinner central portion 28. The cross-sectional configuration is generally rectangular and specifically "H" shaped.

The monofilament 30 shown in FIG. 3 has relatively thicker lateral edges 32,32' joined by an upper surface 34 which is thinner at its center than at the edges due to the concavity of lower surface 36. The cross-sectional configuration is generally rectangular and, specifically, an inverted "U".

The monofilaments 10, 20, 30 may be extruded monofilaments of any known synthetic, polymeric resin in any conventional denier. Representative of preferred monofilament yarns are monofilament yarns of polyesters, polyamides, polyaramids, polyolefins and the like which do not absorb high proportions of moisture. Preferably the monofilaments will have an average diameter of from about 0.008 to 0.04 inches to provide a high degree of stability and structural integrity in the fabric of the invention. Preferably for a dryer felt, low absorption monofilament yarns are employed.

To fabricate the fabrics of the invention, any one of the monofilaments 10, 20 or 30 or a like monofilament characterized by a thinner center than lateral edges is employed as the machine direction yarn in the otherwise conventional weaving of a papermaker's fabric. In FIG. 4, an enlarged portion of such a weave is shown wherein the monofilament 20 is interwoven in a simple weave with conventional, round monofilaments 45 to obtain a fabric 40. In the FIG. 4, the relative proportions of the yarns 20, 45 are not true, the size of the yarns 20 being exaggerated for showing them in greater detail. The round monofilaments 45 may be monofilaments of any synthetic polymeric resins such as described above for the monofilaments 10, 20, 30. Alternatively, the cross-machine direction yarns 45 may be any conventional multi-filament yarn, conventionally used to fabricate papermaker's felts.

Following the manufacture of the fabric 40 by interweaving yarns 20,45 the fabric 40 is heat-set to stabilize the fabric and to draw the yarns into desired relative positions. The machine direction yarns 20 are drawn inwardly of the outer surfaces of the fabric 40 and this pressure collapses the edges 22,22' of the yarns 20 at crossover sites where the yarns 45 crossover the yarns 20. The collapse forms an interlock as will be described hereinafter. The degree of heat-setting required to achieve the desired structure of the fabric 40 will of course vary depending on the polymer nature of the yarns 20 and 45. However, optimum times, temperatures and tensions placed on the fabric during heat-setting can be determined by those skilled in the art, employing trial and error technique for the different yarn materials. In general, heat-setting may be carried out at temperatures of from about 150° F. to 400° F. for from 15 to 60 minutes.

Referring now to FIG. 5, there is seen a cross-sectional side elevation, enlarged, of the monofilament yarn 20 shown in FIG. 5 but after heat-setting. As may be seen, during heat-setting the lateral edges 22,22' deform under the pressure applied by the round monofilament yarns 45 which run in the cross-machine direction. Thus, at crossover sites the yarns 20 and 45 are interlocked so as to create a high degree of fabric diagonal strength and stability. The uncollapsed portions of the lateral edges 22,22' of the machine direction yarns 20 lift the yarn 20 up in the zones between the cross-machine direction yarns 45, off the hot paper sheet in the dryer section of the papermaker's machine, thereby reducing decay and degradation of the yarns by hydrolysis when this construction is used in a dryer belt fabric. This enhances the life of the fabric. The uncollapsed portions of edges 22,22' also absorb the burden of abrasive wear experienced by the fabric 40, protecting the main body of the yarns 20.

It will be appreciated from the view given in FIG. 5 that the yarn 20 presents an "H-beam" construction at yarn sites across the width of the fabric 40. This geometric construction parallel to the width axis of the fabric 40 serves in the fabric 40 to resist tensile and compressive forces vertical to the face of fabric 40. This is particularly useful in a wet press fabric but also helps in a dryer felt by reducing buckling and wrinkles in the fabric as it runs on the papermaker's machine. The "H" beam construction resists sagging of a belt made from such a fabric, across its unsupported width.

FIG. 6 is a cross-sectional, enlarged view of the yarns 45 as they interweave with the monofilament 20 and shows in further detail the interlock developed between yarns 20,45 by heat-setting of the fabric 40.

Although the fabric 40 has been described above as having machine direction yarns 20, it will be appreciated that the yarns 10 or 30 could be substituted for yarns 20 to make fabrics of the invention. The fabrics 40 made with monofilament yarns 30 in the machine direction are particularly useful when the flat surface is employed in the paper sheet contacting surface of the fabric, especially for dryer belt fabrics where the greater paper sheet contacting surface area enhances drying efficiency.

The following examples describe the manner and the process of making and using the invention and set forth the best mode contemplated by the inventor of carrying out the invention but is not to be considered as limiting.

EXAMPLE 1

DRYER FELT

A fabric is prepared in a weave of 0.035" average diameter polyester "H" shaped monofilament (40 per inch) machine direction yarn and 0.028" diameter round monofilament cross-machine direction yarns (18 per inch). After heat setting, a fabric is obtained having a smooth surface contacting outer plane.

The fabric is made endless with a pin seam and installed as a dryer felt on a paper making machine. Any other conventional means of seaming the fabric may also be employed. Paper products are unmarked by the contact with the dryer felt. The belt exhibits a high degree of dimensional stability when run on a papermaking machine.

EXAMPLE 2

WET PRESS FELT

A fabric is prepared in an endless, woven fashion by interweaving nylon multifilaments totalling 80 ends per inch with "H" shaped monofilaments in the cross machine direction.

After heat-setting, several successive layers of carded nylon web are needled to both the face and back side of the woven fabric.

The wet felt produced in this manner has increased compaction resistance and dimensional stability.

EXAMPLE 3

FORMING WIRE

A fabric is prepared in a weave of 0.020" diameter "Ω" shaped polyester monofilament machine direction yarns totalling 56 ends per inch interwoven with 0.020" diameter round monofilament polyester cross-machine direction yarns totalling 40 picks per inch (20 top and 20 bottom in a two layer weave). After heat-setting, a fabric is obtained which has a smooth surface contacting outer plane.

This fabric may be made endless through the use of the well-known joining procedure whereby the ends of the fabric are woven one into the other, or by the use of the pin seam. The fabric provides superior sheet support to result in greater machine efficiencies and improved dimensional stability for longer life.

Those skilled in the art will appreciate that many modifications of the preferred embodiments described above may be made without departing from the spirit and the scope of the invention. For example, the fabric of the invention may be woven to include various stuffer picks, to obtain dryer and press fabrics of different permeabilities as will be appreciated by those skilled in the art.

Similarly, although the fabrics described above are simple, single or double layer weaves, those skilled in the art will appreciate that the scope of the invention includes multi-layered and complex weaves incorporating the shaped monofilaments as a part of their structure.

The felts and forming wires of the invention may also be finished in any conventional manner, i.e.; for example chemical treatments to offer specific properties of runability and resistance to chemical and abrasive degradation.

What is claimed is:

1. A papermachine dryer fabric, which comprises;

a plurality of interwoven machine direction and cross-machine direction yarns, said cross-machine direction yarns being selected from the group consisting of mono- and multi-filament yarns, said machine direction yarns being monofilaments of a synthetic, polymeric resin having a cross-sectional configuration such that the monofilaments are thinner at their center than at their lateral edges;

said lateral edges being deformable under pressure;

crossover points between the interwoven machine direction and cross-machine direction yarns being sited on the thicker lateral edges of the machine direction yarns;

the cross-machine direction yarns being interlocked with the machine direction yarns at the crossover points by deformation of the lateral edge at the crossover points to conform to the shape of cross-machine direction yarns crossing over;

said fabric having the characteristics associated with a heat-set fabric.

2. The fabric of claim 1 wherein the machine direction yarns have an "H" shaped cross-sectional configuration.

3. The fabric of claim 1 wherein the machine direction yarns have an inverted "U" shaped cross-sectional configuration.

* * * * *